US007798915B2

(12) United States Patent
Matsunaga

(10) Patent No.: US 7,798,915 B2
(45) **Date of Patent: *Sep. 21, 2010**

(54) HOLLOW GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 231 days.

This patent is subject to a terminal disclaimer.

(21) Appl. No.: 11/320,899

(22) Filed: Dec. 30, 2005

(65) Prior Publication Data

US 2007/0049411 A1 Mar. 1, 2007

(30) Foreign Application Priority Data

Aug. 23, 2005 (JP) ..... 2005-241750

(51) Int. Cl.
*A63B 53/04* (2006.01)

(52) U.S. Cl. ..... 473/329; 473/345; 473/349

(58) Field of Classification Search ..... 473/324–350
See application file for complete search history.

(56) References Cited

U.S. PATENT DOCUMENTS

| | | | | |
|---|---|---|---|---|
| 4,139,196 | A | 2/1979 | Riley | |
| 5,180,166 | A | 1/1993 | Schmidt et al. | |
| 5,205,560 | A | 4/1993 | Hoshi et al. | |
| 5,255,913 | A | 10/1993 | Tsuchida | |
| 5,346,217 | A | 9/1994 | Tsuchiya et al. | |
| 5,351,958 | A | 10/1994 | Helmstetter | |
| 5,411,255 | A | 5/1995 | Kurashima et al. | |
| 5,511,786 | A | 4/1996 | Antonious | |
| 5,573,467 | A | 11/1996 | Chou et al. | |
| 5,755,627 | A | 5/1998 | Yamazaki et al. | |
| 5,916,038 | A | 6/1999 | Uchiyama et al. | |
| 5,954,594 | A | 9/1999 | Uchiyama et al. | |
| 6,162,133 | A * | 12/2000 | Peterson | 473/345 |
| 6,348,013 | B1 | 2/2002 | Kosmatka | |
| 6,494,790 | B1 | 12/2002 | Toyota et al. | |
| 6,572,491 | B2 | 6/2003 | Hasebe et al. | |
| 6,719,645 | B2 * | 4/2004 | Kouno | 473/345 |
| 6,783,465 | B2 | 8/2004 | Matsunaga | |
| 6,783,466 | B2 | 8/2004 | Seki et al. | |
| 6,830,519 | B2 | 12/2004 | Reed et al. | |

(Continued)

FOREIGN PATENT DOCUMENTS

GB 2 249 031 A 4/1992

(Continued)

OTHER PUBLICATIONS

Jackson, Jeff. The Modern Guide to Golf Clubmaking. Ohio: Dynacraft Golf Products, Inc., copyright 1994, p. 237.*

(Continued)

*Primary Examiner*—Alvin A Hunter
(74) *Attorney, Agent, or Firm*—Sughrue Mion, PLLC

(57) ABSTRACT

This invention provides a hollow golf club head in which the ratio of the average thickness of a sole portion to that of a crown portion is 1:0.3 to 0.8. At least two regions having thicknesses different from each other are formed on the crown portion, and the area of the thinnest region of the regions having thicknesses different from each other in the crown portion is larger than that of the thickest region.

13 Claims, 13 Drawing Sheets

U.S. PATENT DOCUMENTS

| | | | | |
|---|---|---|---|---|
| 6,945,876 | B2 | 9/2005 | Nakahara et al. | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0236133 | A1* | 12/2003 | Shimazaki et al. | 473/345 |
| 2004/0078955 | A1 | 4/2004 | Matsunaga | |
| 2004/0204264 | A1 | 10/2004 | Matsunaga et al. | |
| 2005/0003904 | A1 | 1/2005 | Imamoto et al. | |
| 2005/0023329 | A1 | 2/2005 | Song | |
| 2005/0124436 | A1 | 6/2005 | Kakiuchi et al. | |
| 2006/0063608 | A1 | 3/2006 | Mori et al. | |

FOREIGN PATENT DOCUMENTS

| | | | | |
|---|---|---|---|---|
| JP | 07-155410 | A | | 6/1995 |
| JP | 7-284546 | A | | 10/1995 |
| JP | 10263120 | A | | 10/1998 |
| JP | 11-057085 | A | | 3/1999 |
| JP | 2000-317018 | A | | 11/2000 |
| JP | 2001-346918 | A | | 12/2001 |
| JP | 2002315855 | A | | 10/2002 |
| JP | 2003-52866 | A | | 2/2003 |
| JP | 2003-79768 | A | | 3/2003 |
| JP | 2003-88601 | A | | 3/2003 |
| JP | 2004-65660 | A | | 3/2004 |
| JP | 2004-167127 | A | | 6/2004 |
| JP | 2004-180759 | A | | 7/2004 |
| JP | 2004-222792 | A | | 8/2004 |
| JP | 2004-229820 | A | | 8/2004 |
| JP | 2005006698 | A | * | 1/2005 |
| JP | 2005130935 | A | * | 5/2005 |
| JP | 2005-137788 | A | | 6/2005 |
| WO | WO 99/22824 | A1 | | 5/1999 |

OTHER PUBLICATIONS

Chinese Office Action Mailed Apr. 3, 2009.
Chinese Patent Office Action dated Aug. 7, 2009.

* cited by examiner

HOLLOW GOLF CLUB HEAD

FIELD OF THE INVENTION

The present invention relates to a hollow golf club head in which the launch angle of a ball is increased so that the traveling distance of a shot can be increased.

BACKGROUND OF THE INVENTION

In recent years, hollow golf club heads have been proposed in which not only their face portion but also their crown portion deform elastically when hitting a ball, to increase the launch angle, so as to increase the traveling distance of a shot.

Japanese Patent Laid-Open No. 2003-52866 discloses a hollow golf club head made of metal and having a face portion, sole portion, side portion, crown portion, and hosel portion. This golf club head is formed of a front part and back part. The front part is made of a cast product in which at least the main portion of the crown portion and the face portion are integrally formed. In the back part, portions other than the front part are integrally formed. The front and back parts are joined to each other.

Japanese Patent Laid-Open No. 2003-79768 discloses a hollow golf club head made of metal and having at least a face portion, sole portion, side portion, and crown portion. A metal material that forms the crown portion has the lowest modulus of longitudinal elasticity.

Japanese Patent Laid-Open No. 2003-88601 discloses a hollow golf club head made of metal and having a face portion, sole portion, toe-side side portion, heel-side side portion, back-side side portion, crown portion, and hosel portion. The crown portion has a plurality of grooves extending from the toe-side side portion to the heel-side side portion.

Japanese Patent Laid-Open No. 2005-137788 discloses a hollow golf club head having a face portion with a face surface to hit the ball, and a head main body portion continuous to the rear surface of the face portion and extending to the back of the head. The head main body portion includes a crown portion, sole portion, and side portion which respectively form a head upper portion, head bottom portion, and head side portion. The crown portion includes a crown front portion and crown rear portion. The crown front portion forms a front region extending from the rear surface of the face portion to a position at a distance 0.15 times a crown depth length Lc. The crown rear portion forms a rear region extending from the rear surface of the face portion to a position at a distance 0.30 times to 1.0 time the crown depth length Lc. The crown front portion has a rigidity lower than that of the crown rear portion.

The conventional golf club heads described above still have room for improvement in terms of increasing the launch angle of a ball.

SUMMARY OF THE INVENTION

The present invention has been made in order to overcome the deficits of prior art.

According to the aspects of the present invention, it is provided a hollow golf club head having a sole portion and a crown portion, wherein a ratio of an average thickness of the sole portion to that of the crown portion is 1:0.3 to 0.8, at least two regions having thicknesses different from each other are formed on the crown portion, and an area of a thinnest region is larger than that of a thickest region in the crown portion.

The hollow golf club head according to the aspects of the invention can increase the launch angle of a ball so that the traveling distance of a shot can be further increased.

According to the aspects of the present invention, the sole portion of the golf club head refers to a portion extending backward from the lower portion of a face portion of the golf club head to form the bottom portion of the head. The crown portion of the golf club head refers to a portion extending backward from the upper portion of the face portion to form the upper portion of the head. A side portion of the golf club head refers to a portion extending backward from between the upper and lower portions of the face portion to form a head side portion. The side portion includes a toe-side side portion, heel-side side portion, and back-side side portion.

According to the aspects of the present invention, a preferable value of the ratio of the average thickness of the sole portion to that of the crown portion is 1:0.5 to 0.7.

According to the aspects of the present invention, the ratio of the area of the thinnest region (crown thinnest region) to that of the thickest region (crown thickest region) is preferably 1:0.2 to 0.6.

According to the aspects of the present invention, at least two regions having thicknesses different from each other are formed on the sole portion, and an area of a thickest region of the regions having thicknesses different from each other on the sole portion is preferably set to be larger than that of a thinnest region. The ratio of the area of the thickest region (sole thickest region) to that of the thinnest region (sole thinnest region) is preferably 1:0.2 to 0.6.

According to the aspects of the present invention, a crown thin-walled region as the crown thinnest region is formed on the face side of the crown portion, and a crown thick-walled region as the crown thickest region is formed on the back side of the crown portion. With this arrangement, two regions having thicknesses different from each other are formed on the crown portion, and the ratio of the average thickness of the crown thick-walled region to that of the crown thin-walled region can be set to 1:0.5 to 0.9. A preferable value of the ratio of the average thickness of the crown thick-walled region to that of the crown thin-walled region is 1:0.5 to 0.7.

According to the aspects of the present invention, a sole thick-walled region as the sole thickest region is formed on the face side of the sole portion, and a sole thin-walled region as the sole thinnest region is formed on the back side of the sole portion. With this arrangement, two regions having thicknesses different from each other are formed on the sole portion, and the ratio of the average thickness of the sole thick-walled region to that of the sole thin-walled region can be set to 1:0.3 to 0.8. A preferable value of the ratio of the average thickness of the sole thick-walled region to that of the sole thin-walled region is 1:0.5 to 0.7.

According to the aspects of the present invention, in order to increase the launch angle of a ball, the ratio of the average thickness of the sole portion to that of the side portion can be set to 1:0.3 to 0.8. A preferable value of the ratio of the average thickness of the sole portion to that of the side portion is 1:0.5 to 0.7.

According to the aspects of the present invention, preferably, the average thickness of the sole portion is 0.9 mm to 2.0 mm, the average thickness of the crown portion is 0.5 mm to 1.2 mm, the average thickness of the crown thickest region is 1.0 mm to 2.0 mm, the average thickness of the crown thinnest region is 0.3 mm to 0.7 mm, the average thickness of the sole thickest region is 1.5 mm to 3.0 mm, the average thickness of the sole thinnest region is 0.7 mm to 1.2 mm, and the average thickness of the side portion is 0.5 mm to 1.2 mm.

According to the aspects of the present invention, a ratio of a rigidity of the sole portion to that of the crown portion is preferably 1:0.1 to 0.8. A more preferable value of the ratio of the rigidity of the sole portion to that of the crown portion is 1:0.2 to 0.6.

According to the aspects of the present invention, the rigidity refers to a value calculated by the following equation (x):

$$\text{rigidity(unit:MPa·mm}^4\text{)}=E\times I \quad \text{(x)}$$

where E: Young's modulus (unit: MPa)

I: moment of inertia of area (unit: $mm^4$)

Young's modulus E depends on the material constituting the golf club head, and the moment I of inertia of area depends on the thickness of the constituent of the golf club head. If the thickness is the same, the ratio of rigidity is determined by the ratio of magnitudes of Young's modulus E. If the material is the same, the ratio of rigidity is determined by the value of the cube of the ratio of the thicknesses.

According to the aspects of the present invention, in order to increase the launch angle of a ball, a ratio of the rigidity of the sole portion to that of the side portion is desirably 1:0.1 to 0.8. A more preferable vale of the ratio of the rigidity of the sole portion to that of the side portion is 1:0.2 to 0.6.

The manufacturing method for the golf club head according to the aspects of the present invention is not particularly limited. For example, the golf club head can be manufactured by closing a face opening of a head main body with a face member. In this case, the material and molding method for the head main body are not particularly limited. Titanium, a titanium alloy, stainless steel, an amorphous material, or the like can be used as the material. The head main body can be monolithically molded by casting. The material and molding method for the face member are also not particularly limited. As with the material, titanium, a titanium alloy, stainless steel, an amorphous material, or the like can be used. As the molding method, forging, press forming of pressing a plate material, or die casting is preferable.

The method for joining the face member to the head main body is not particularly limited, but plasma welding, laser welding, or electron beam welding is suitable in terms of finishing the joined portion with a good appearance and improving the weight accuracy of the golf club head. In this case, plasma welding can be employed in which a welding target material is dissolved by a high-temperature energy generated by plasma arc and solidified again to weld. As for laser welding, known laser welding which uses a gas laser such as CO laser or $CO_2$ laser, or a solid laser such as a YAG laser can be employed. As for electron beam welding, known electron beam welding which uses an electron beam having an appropriate output can be employed.

The golf club head according to the aspects of the present invention can be formed as, e.g., a wood type golf club head or utility type golf club head having a hollow portion. More specifically, the golf club head according to the aspects of the present invention can be formed as a hollow golf club head having the following head volume and loft angle:

(a) a hollow golf club head having a head volume of 250 $cm^3$ to 470 $cm^3$ and a loft angle in a range from 7 to 15 degrees, (b) a hollow golf club head having a head volume of 150 $cm^3$ to 250 $cm^3$ and a loft angle in a range from 12 to 28 degrees, and (c) a hollow golf club head having a head volume of 70 $cm^3$ to 150 $cm^3$ and a loft angle in a range from 15 to 32 degrees.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
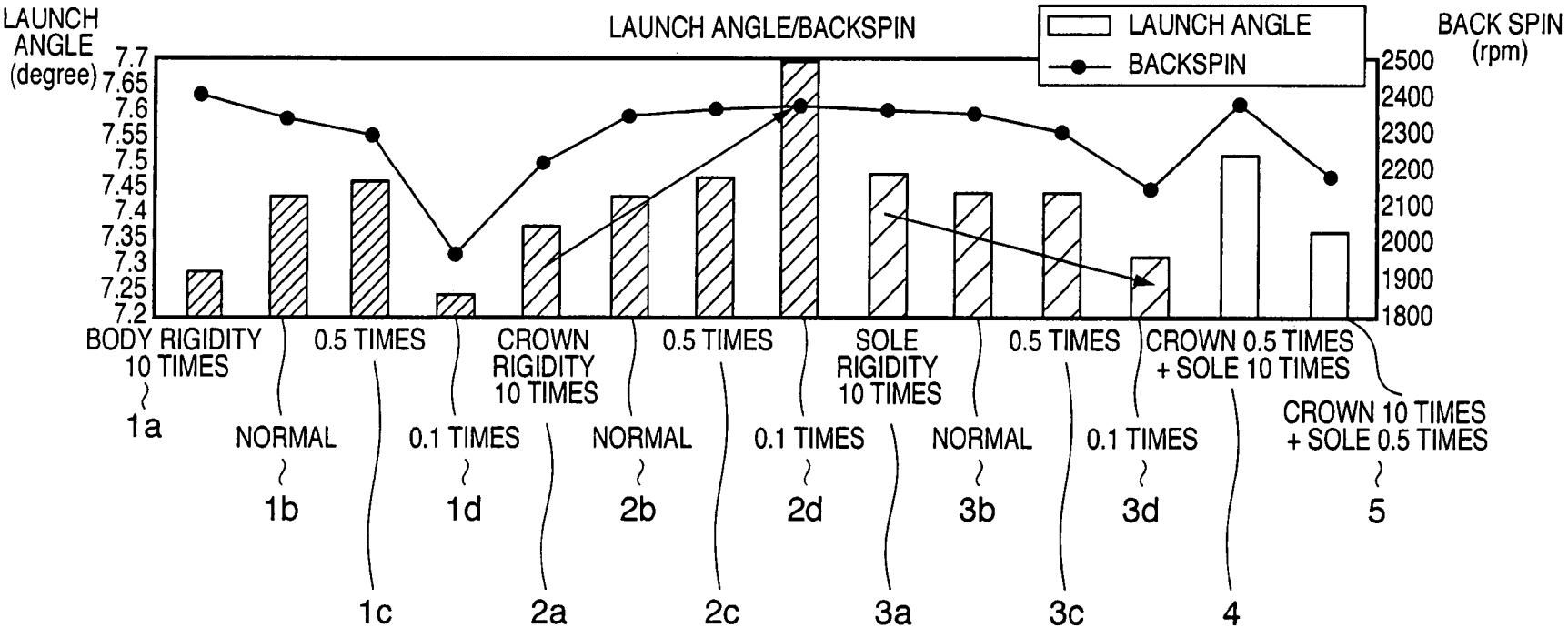
FIG. 1 is a graph showing variations of the launch angle of a ball and the backspin amount when body rigidity, crown rigidity, and sole rigidity of a golf club head are changed.

First, an experiment that demonstrates the effect of the present invention will be described. FIG. 1 is a graph showing variations of the launch angle of a ball angle and the backspin amount when the rigidity of the entire golf club head (body rigidity), the rigidity of the crown portion (crown rigidity), and the rigidity of the sole portion (sole rigidity) are changed. Referring to FIG. 1, sample number 1*a* indicates a golf club head with body rigidity 10 times the normal value. Sample number 1*b* indicates a golf club head with normal body rigidity (1 time). Sample number 1*c* indicates a golf club head with body rigidity 0.5 times the normal value. Sample number 1*d* indicates a golf club head with body rigidity 0.1 times the normal value. Sample number 2*a* indicates a golf club head with crown rigidity 10 times the normal value. Sample number 2*b* indicates a golf club head with normal crown rigidity (1 time). Sample number 2*c* indicates a golf club head with crown rigidity 0.5 times the normal value. Sample number 2*d* indicates a golf club head with crown rigidity 0.1 times the normal value. Sample number 3*a* indicates a golf club head with sole rigidity 10 times the normal value. Sample number 3*b* indicates a golf club head with normal sole rigidity (1 time). Sample number 3*c* indicates a golf club head with sole rigidity 0.5 times the normal value. Sample number 3*d* indicates a golf club head with sole rigidity 0.1 times the normal value. Sample number 4 indicates a golf club head with crown rigidity 0.5 times the normal value and sole rigidity 10 times the normal value. Sample number 5 indicates a golf club head with crown rigidity 10 times the normal value and sole rigidity 0.5 times the normal value. The results of FIG. 1 show that when the rigidity of the crown portion is decreased and that of the sole portion is increased, the launch angle of a ball increases.

Figure 2:
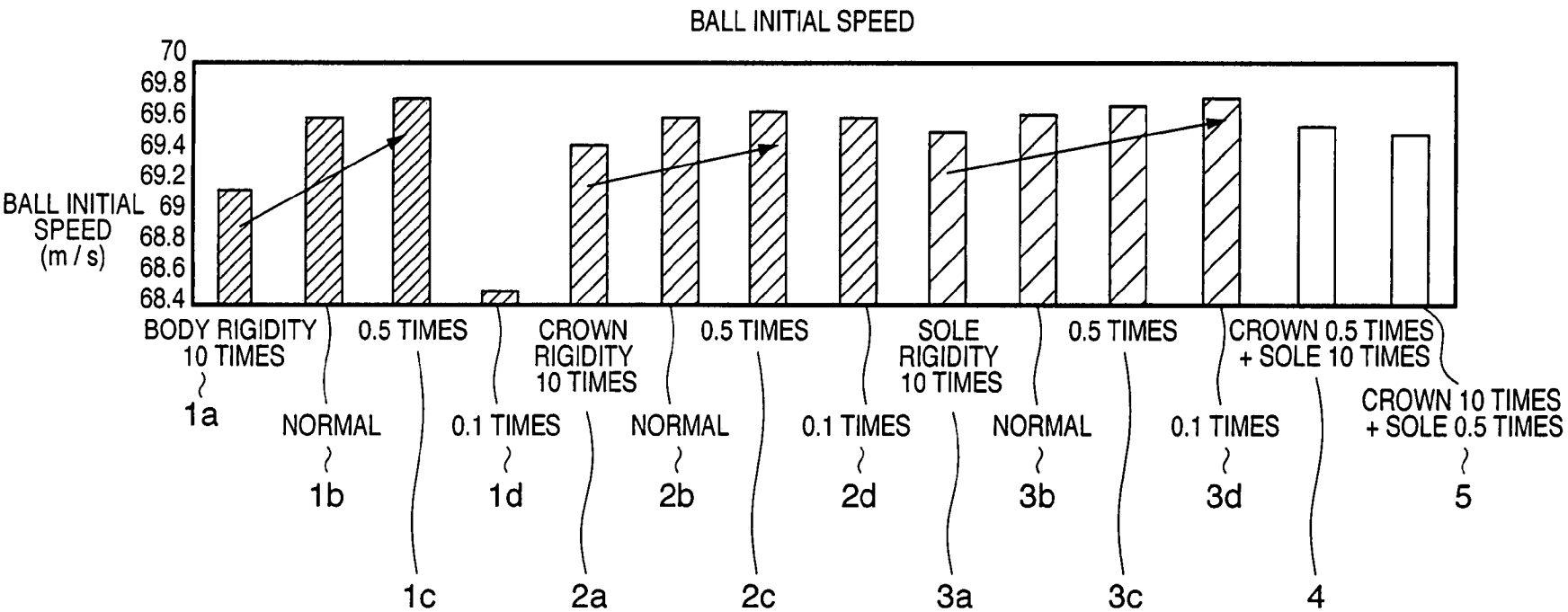
FIG. 2 is a graph showing variations of the initial speed of a ball when the body rigidity, crown rigidity, and sole rigidity of the golf club head are changed.

FIG. 2 is a graph showing variations of the initial speed of a ball when body rigidity, crown rigidity, and sole rigidity are changed. FIG. 2 is used as a comparison with the present invention in which the launch angle of a ball is increased. Referring to FIG. 2, sample numbers 1*a* to 1*d*, 2*a* to 2*d*, 3*a* to 3*d*, 4, and 5 indicate the same golf club heads as those of FIG. 1. The results of FIG. 2 show that when the rigidities of both the crown portion and sole portion are decreased, the initial speed of a ball increases.

Figure 3:
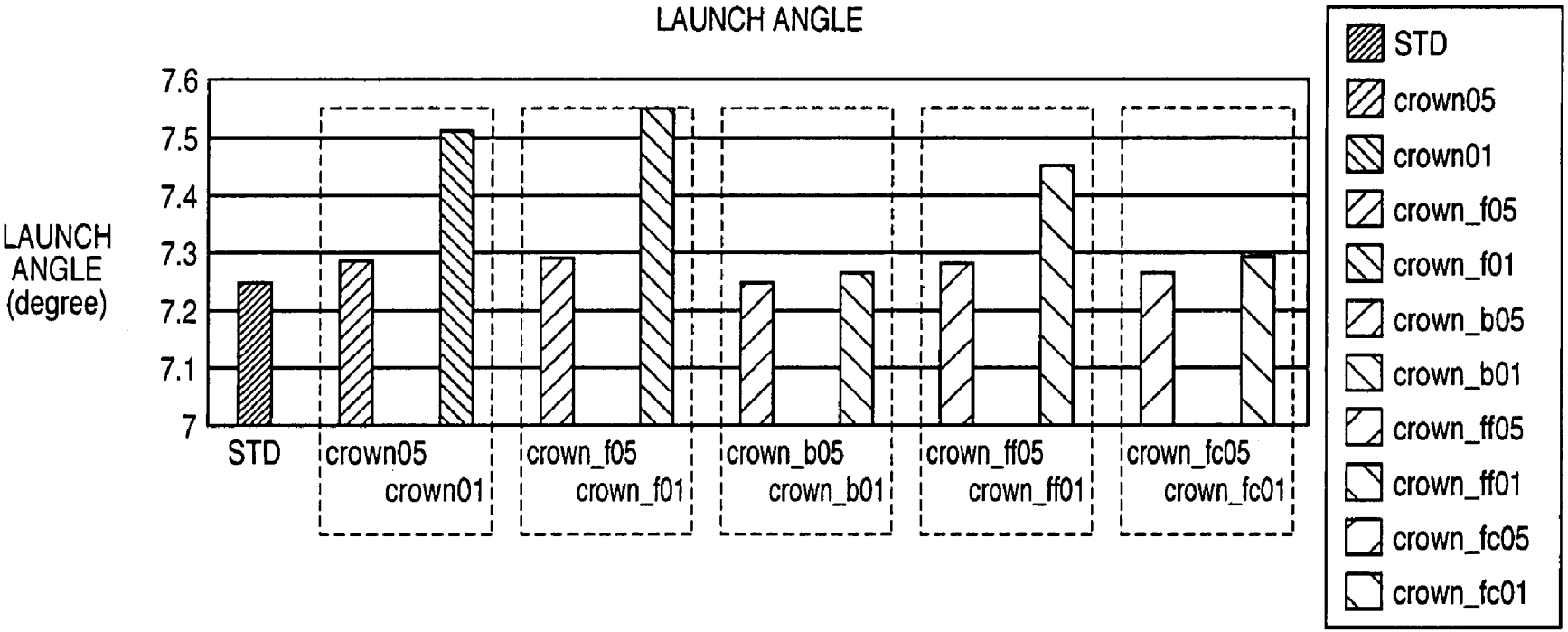
FIG. 3 is a graph showing variations of the launch angle of a ball when rigidity of a crown portion of the golf club head is changed entirely or partially.
Figure 4:
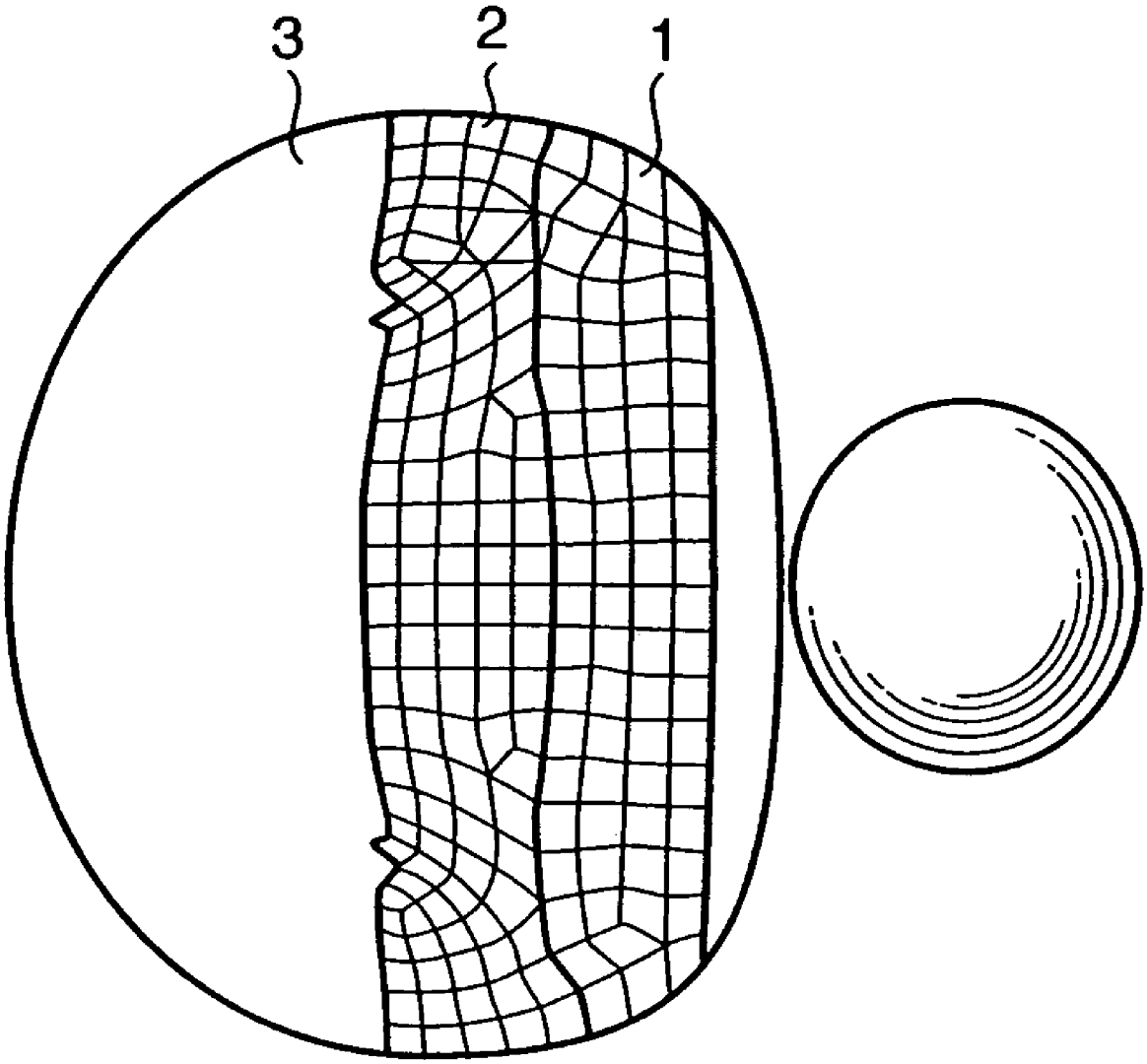
FIG. 4 is a view showing respective regions of the crown portion.

FIG. 3 is a graph showing variations of the launch angle of a ball when the rigidity of the crown portion of the golf club head is changed entirely or partially. The sample numbers in FIG. 3 indicate the samples shown in Table 1. In these samples, the rigidities of respective regions (1), (2), and (3) of the crown portion shown in FIG. 4 are set as in Table 1. The results of FIG. 3 show that when the thickness of the face-side portion of the crown portion is decreased, the effect of increasing the launch angle of a ball is large. When the thickness of only the back-side portion or central portion of the crown portion is decreased, the effect of increasing the launch angle of a ball is small.

TABLE 1

| | Rigidity Scale in Each Region (times) (ratio to titanium) | | |
|---|---|---|---|
| Sample | Region (1) | Region (2) | Region (3) |
| STD | 1 | 1 | 1 |
| crown05 | 0.5 | 0.5 | 0.5 |
| crown01 | 0.1 | 0.1 | 0.1 |
| crown_f05 | 0.5 | 0.5 | 1 |
| crown_f01 | 0.1 | 0.1 | 1 |
| crown_b05 | 1 | 1 | 0.5 |
| crown_b01 | 1 | 1 | 0.1 |
| crown_ff05 | 0.5 | 1 | 1 |
| crown_ff01 | 0.1 | 1 | 1 |
| crown_fc05 | 1 | 0.5 | 1 |
| crown_fc01 | 1 | 0.1 | 1 |

Figure 5:
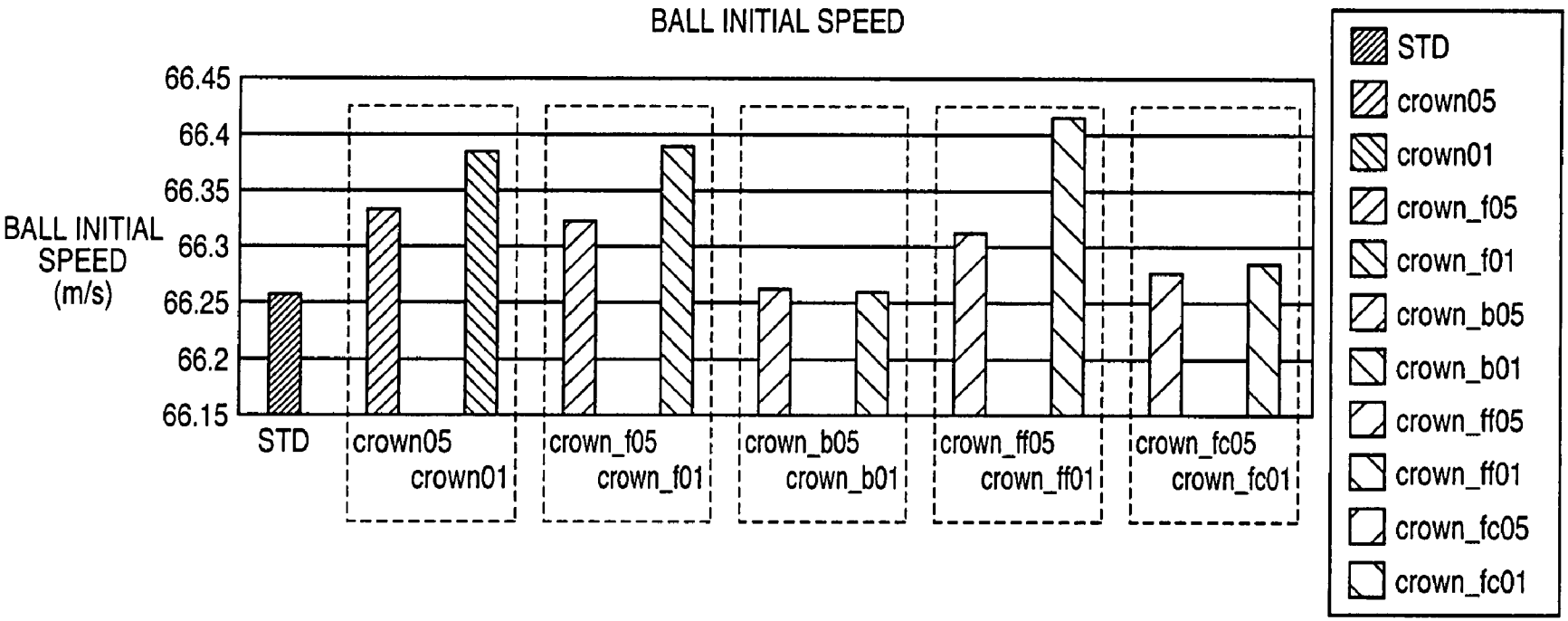
FIG. 5 is a graph showing variations of the initial speed of a ball when the rigidity of the crown portion of the golf club head is changed entirely or partially.

FIG. 5 is a graph showing variations of the initial speed of a ball when the rigidity of the crown portion of the golf club head is changed entirely or partially. The sample numbers in FIG. 5 refer to the samples shown in Table 1. The results of FIG. 5 show that when the thickness of the face-side portion of the crown portion is decreased, the effect on the increase of the initial speed of the ball is large. When the thickness of only the back-side portion or central portion of the crown portion is decreased, the effect on the increase of the initial speed of the ball is small. These results are the same as those concerning the launch angle of a ball described above.

Figure 6:
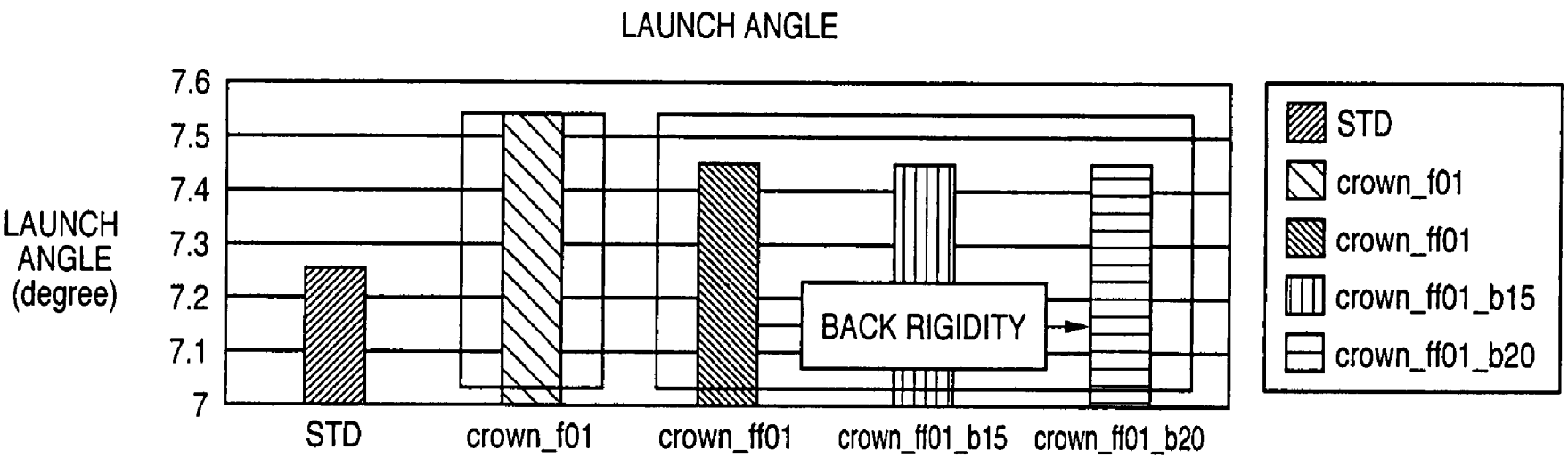
FIG. 6 is a graph showing variations of the launch angle of a ball when rigidity of a back-side region of the crown portion of the golf club head is increased.

FIG. 6 is a graph showing variations of the launch angle when the rigidity of the back-side region of the crown portion of the golf club head is increased. The sample numbers in FIG. 6 refer to the samples shown in Table 2. The results of FIG. 6 show that the rigidity of the back-side region of the crown portion hardly affects the launch angle of a ball. However, it is assumed that increasing the rigidity of the back-side portion of the crown portion favorably affects the hitting sound or hitting impression.

TABLE 2

| | Rigidity Scale in Each Region (times) (ratio to titanium) | | |
|---|---|---|---|
| Sample | Region (1) | Region (2) | Region (3) |
| STD | 1 | 1 | 1 |
| crown_f01 | 0.1 | 0.1 | 1 |
| crown_ff01 | 0.1 | 1 | 1 |
| crown_ff01_b15 | 0.1 | 1 | 15 |
| crown_ff01_b20 | 0.1 | 1 | 20 |

Figure 7:
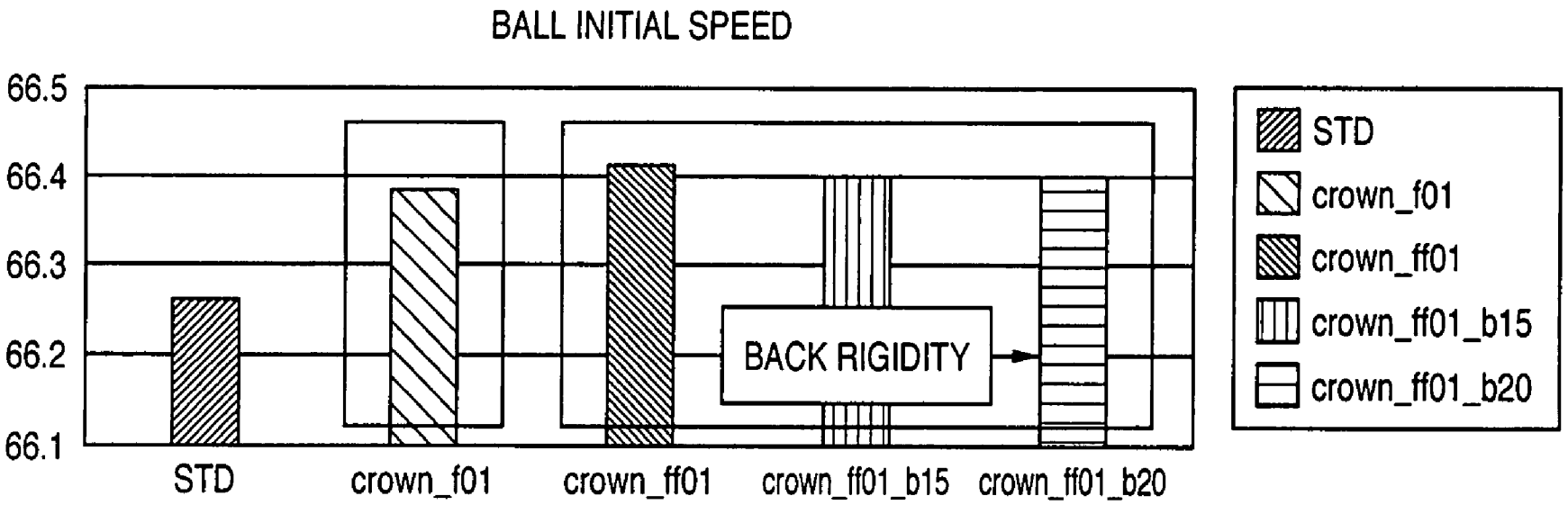
FIG. 7 is a graph showing variations of the initial speed of a ball when the rigidity of the back-side region of the crown portion of the golf club head is increased.

FIG. 7 is a graph showing variations of the initial speed of a ball when the rigidity of the back-side region of the crown portion of the golf club head is increased. The sample numbers in FIG. 7 refer to the samples shown in Table 2. The results of FIG. 7 show that the rigidity of the back-side region of the crown portion hardly affects the initial speed of a ball. These results are the same as those concerning the launch angle of a ball described above.

Figure 8:
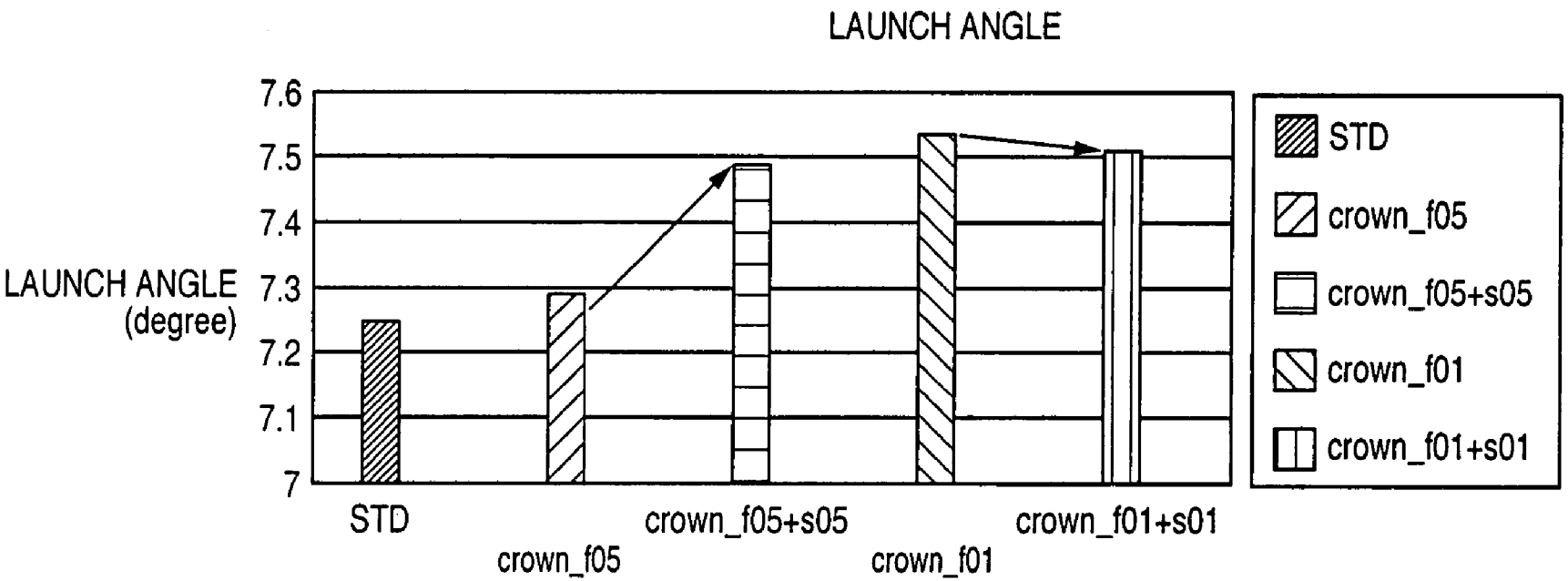
FIG. 8 is a graph showing variations of the launch angle of a ball when the rigidities of the crown portion and side portion of the golf club head are partially changed and decreased, respectively.

FIG. 8 is a graph showing variations of the launch angle when the rigidities of the crown portion and side portion of the golf club head are partially changed and decreased, respectively. The sample numbers in FIG. 8 refer to the samples shown in Table 3. The results of FIG. 8 demonstrate that when the rigidity of the side portion is decreased to a certain degree, an increase in the launch angle of a ball can be obtained. When the rigidity of the side portion is decreased excessively, the increase effect regarding the launch angle of a ball cannot be obtained.

TABLE 3

| | Rigidity Scale in Each Region (times) (ratio to titanium) | | | |
|---|---|---|---|---|
| Sample | Region (1) | Region (2) | Region (3) | Side Portion |
| STD | 1 | 1 | 1 | 1 |
| crown_f05 | 0.5 | 0.5 | 1 | 1 |
| crown_f05_s05 | 0.5 | 0.5 | 1 | 0.5 |
| crown_f01 | 0.1 | 0.1 | 1 | 1 |
| crown_f01_s01 | 0.1 | 0.1 | 1 | 0.1 |

Figure 9:
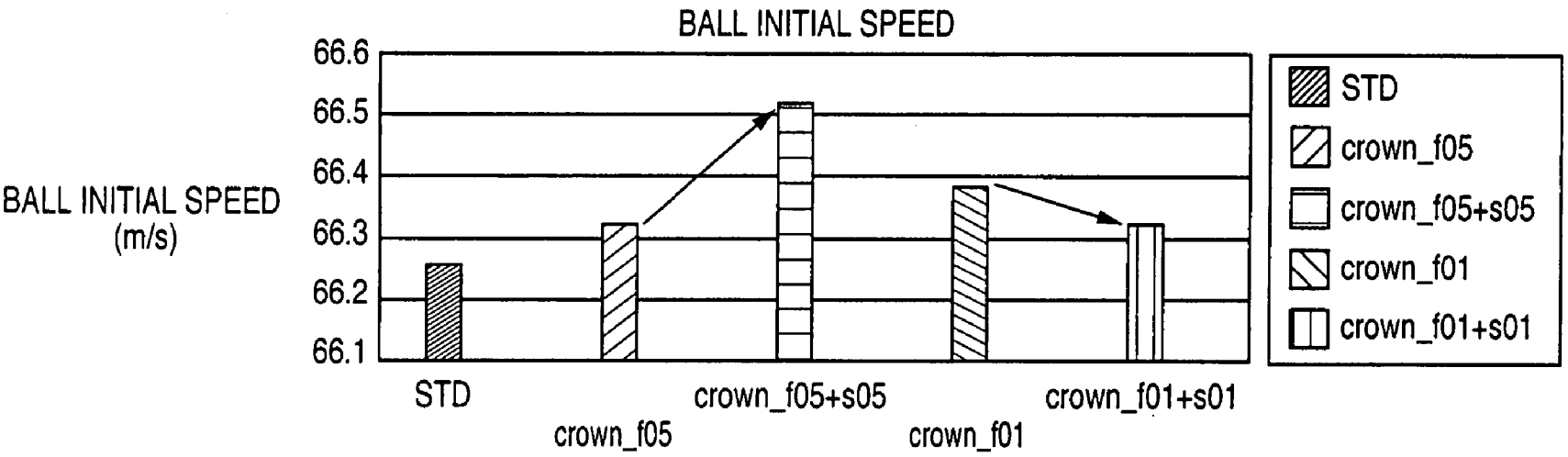
FIG. 9 is a graph showing variations of the initial speed of a ball when the rigidities of the crown portion and side portion of the golf club head are partially changed and decreased, respectively.

FIG. 9 is a graph showing variations of the initial speed of a ball when the rigidities of the crown portion and side portion of the golf club head are partially changed and decreased, respectively. The sample numbers in FIG. 9 refer to the samples shown in Table 3. The results of FIG. 9 demonstrate that when the rigidity of the side portion is decreased to a certain degree, an increase effect on the initial speed of a ball can be obtained. When the rigidity of the side portion is decreased excessively, the increase effect on the initial speed of a ball disappears. These results are the same as those concerning the launch angle of a ball described above.

Figure 10:
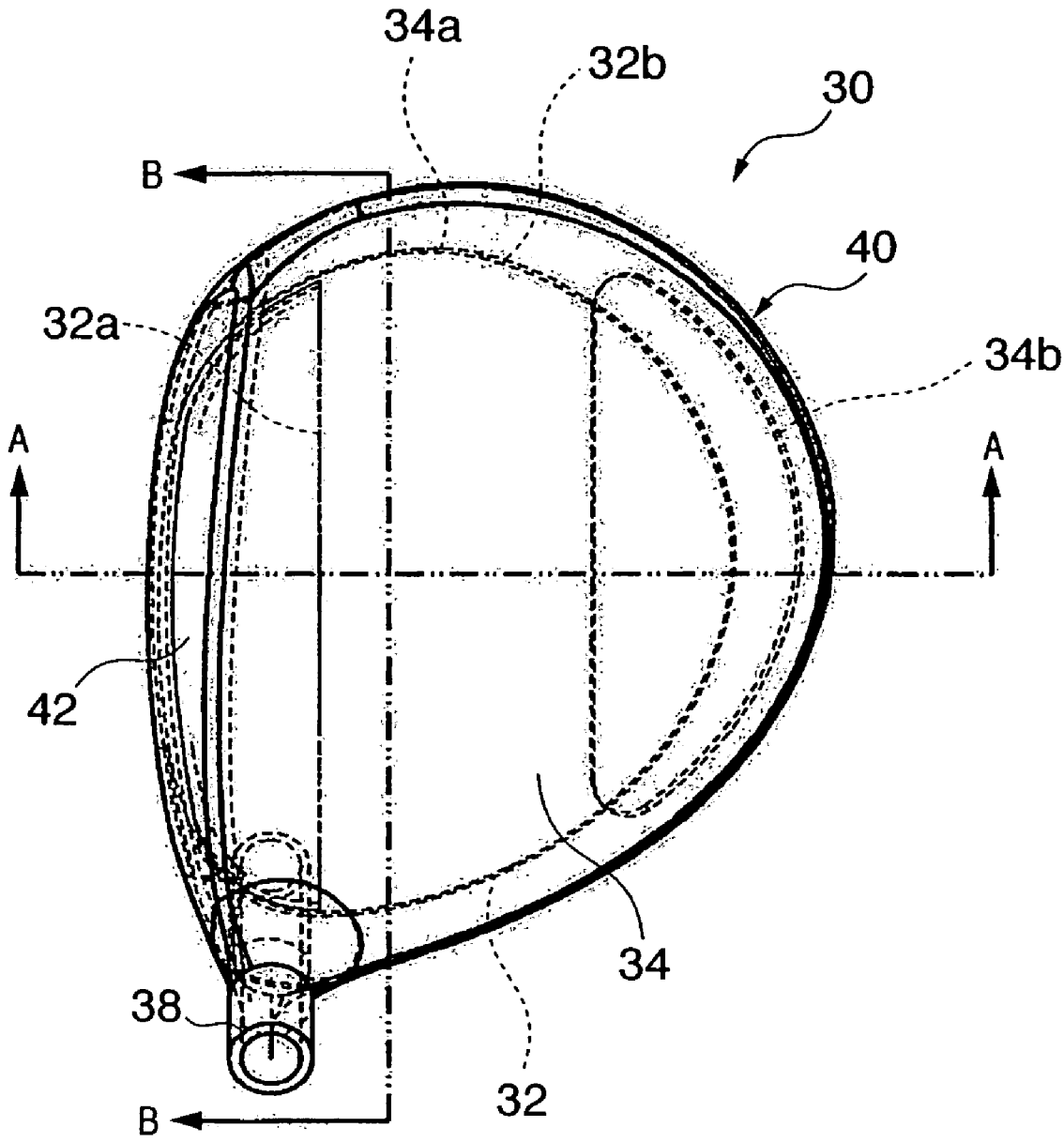
FIG. 10 is a plan view showing a golf club head according to an embodiment of the present invention.
Figure 11:
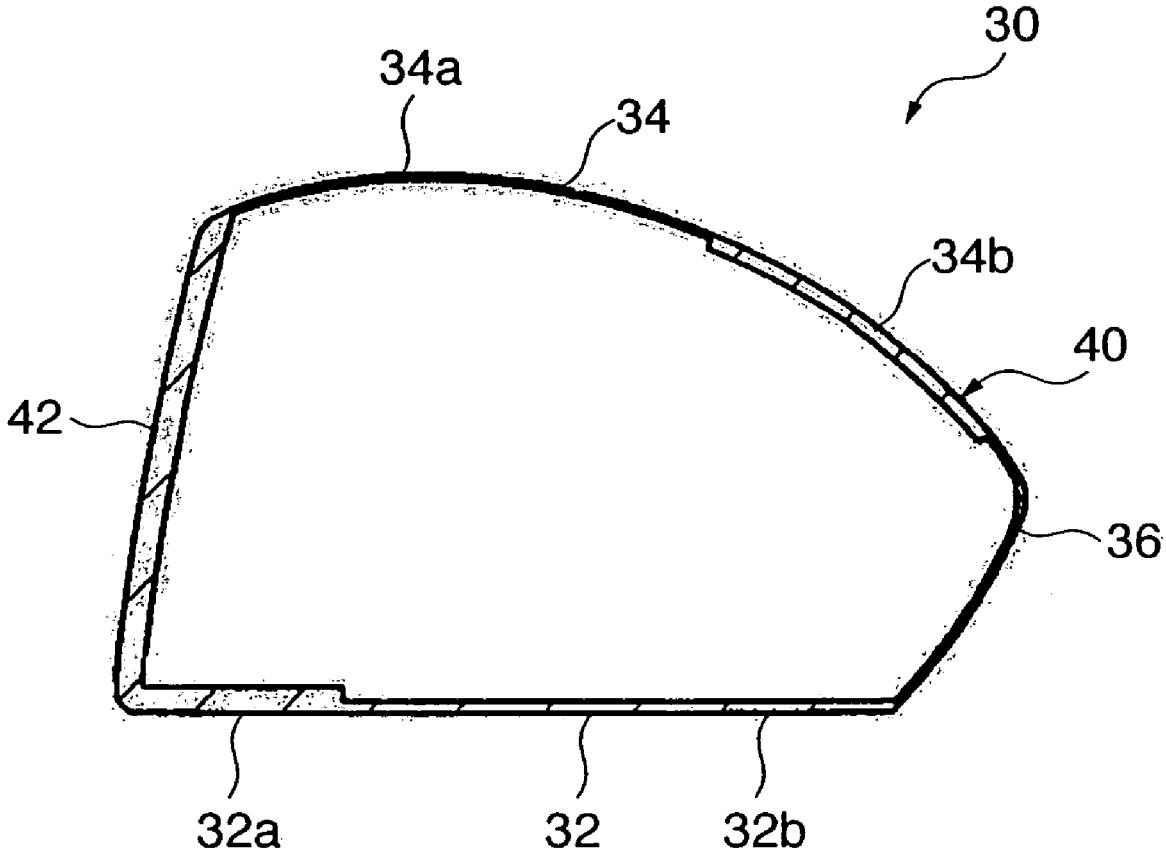
FIG. 11 is a sectional view taken along the line A-A of FIG. 10.
Figure 12:
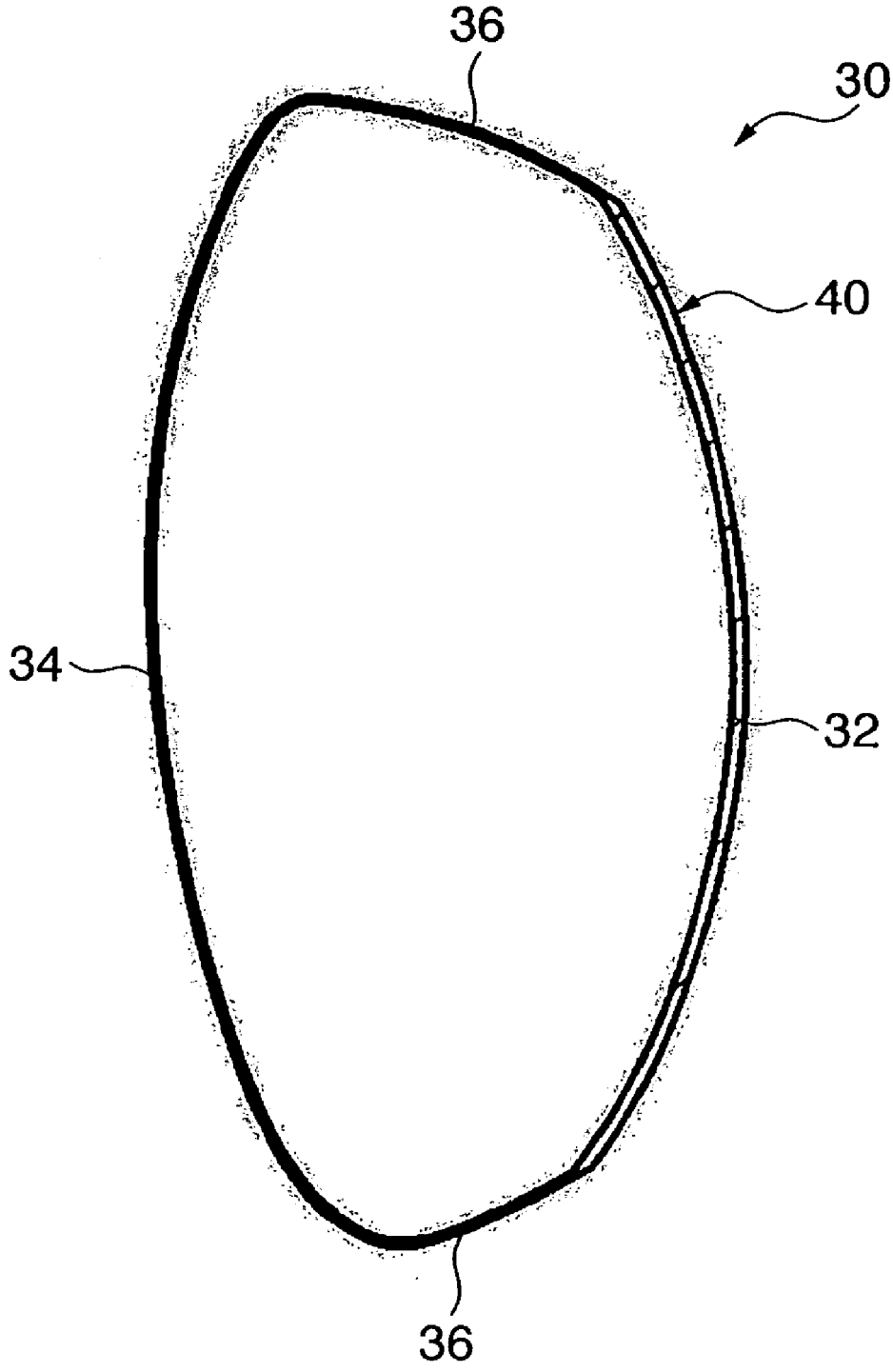
FIG. 12 is a sectional view taken along the line B-B of FIG. 10.

FIG. 10 is a plan view showing a golf club head according to an embodiment of the present invention, FIG. 11 is a sectional view taken along the line A-A of FIG. 10, and FIG. 12 is a sectional view taken along the line B-B of FIG. 10.

A golf club head 30 according to this embodiment is obtained by fixing a face member 42 to the face opening of a head main body 40 having a sole portion 32, crown portion 34, side portion 36, and hosel portion 38 by plasma welding. The material of the head main body 40 is 6-4Ti (Ti-6Al-4V) and the material of the face member 42 is SP700 (Ti-4. 5Al-3V-2Fe-2Mo). The golf club head of this embodiment is formed as a No. 1 wood golf club head having a head volume of 400 $cm^3$.

In the golf club head 30 according to this embodiment, a sole thick-walled region 32*a* having a thickness of 2.5 mm is formed as a sole thickest region on the face side of the sole portion 32, and a sole thin-walled region 32*b* having a thickness of 1.2 mm is formed as a sole thinnest region on the back side of the sole portion 32. A crown thin-walled region 34*a* having a thickness of 0.6 mm is formed as a crown thinnest region on the face side of the crown portion 34, and a crown thick-walled region 34*b* having a thickness of 1.5 mm is formed as a crown thickest region on the back side of the crown portion 34. The thicknesses of the sole thick-walled region 32*a*, sole thin-walled region 32*b*, crown thin-walled region 34*a*, and crown thick-walled region 34*b* are uniform.

In the golf club head 30 according to this embodiment, the area of the crown thin-walled region 34*a* is larger than that of the crown thick-walled region 34*b*, and the area of the sole thick-walled region 32*a* is larger than that of the sole thin-walled region 32*b*. More specifically, the ratio of the area of the crown thin-walled region 34*a* to that of the crown thick-walled region 34*b* is 1:0.35, and the ratio of the area of the sole thick-walled region 32*a* to that of the sole thin-walled region 32*b* is 1:0.6.

In the golf club head 30 according to this embodiment, the average thickness of the sole portion 32 is 2.0 mm, and that of the crown portion 34 is 0.9 mm. Hence, in the golf club head 30 according to this embodiment, the ratio of the average thickness of the sole portion 32 to that of the crown portion 34 is 1:0.45, the ratio of the average thickness of the crown thick-walled region 34*b* to that of the crown thin-walled region 34*a* is 1:0.4, and the ratio of the average thickness of the sole thick-walled region 32*a* to that of the sole thin-walled region 32*b* is 1:0.48.

The thicknesses of the side portion 36 and face member 42 are uniform, which are 0.6 mm and 3 mm, respectively. Hence, the ratio of the average thickness of the sole portion 32 to that of the side portion 36 is 1:0.33.

Furthermore, in the golf club head 30 according to this embodiment, the ratio of the rigidity of the sole portion 32 to that of the crown portion 34 is 1:0.3, and the ratio of the rigidity of the sole portion 32 to that of the side portion 36 is 1:0.2.

The thick-walled region 32*a* can be formed from the face side end of the sole portion 32 in a range of 20 mm to 55 mm, preferably, 25 mm to 40 mm in the direction of the face side to the back side. The crown thin-walled region 34*b* in the golf club head 30 can be formed from the face side end of the crown portion 34 in a range of 20 mm to 45 mm, preferably, 25 mm to 40 mm in the direction of the face side to the back side.

Figure 13:
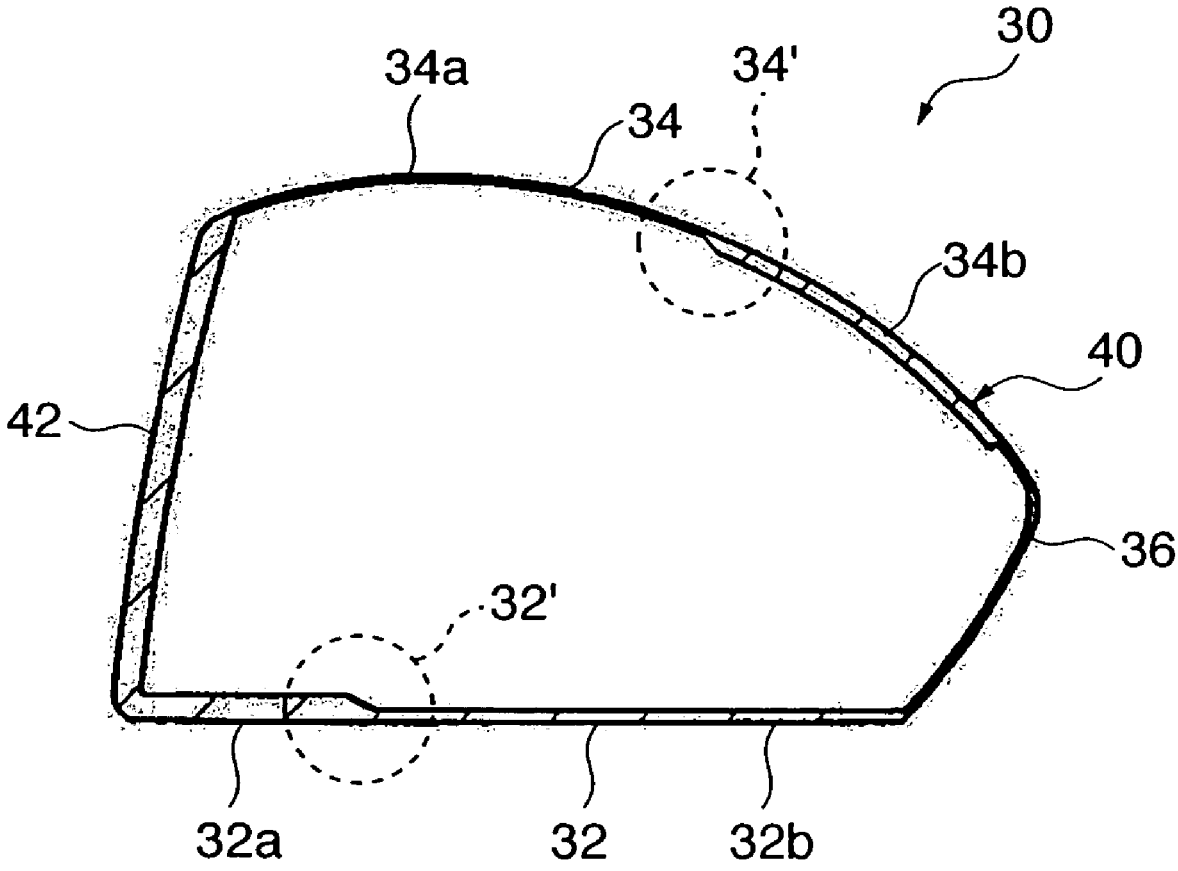
FIG. 13 is a sectional view of an alternative embodiment of the embodiment.

It is preferable that the thickness of the boundary portion between the thick-walled region 32*a* and the thin-walled region 32*b* and the thickness of the boundary portion between the thin-walled region 34*a* and the thick-walled region 34*b* can be gradually changed. FIG. 13 shows an alternative embodiment of the golf club head 30. In the alternative embodiment, the thickness of the boundary portion 32' between the thick-walled region 32*a* and the thin-walled region 32*b* and the thickness of the boundary portion 34' between the thin-walled region 34*a* and the thick-walled region 34*b* are gradually changed. This construction reduces the stress concentration at the boundary portions 32' and 34'.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2005-241750 filed on Aug. 23, 2005, the entire contents of which are hereby incorporated by reference herein.

What is claimed is:

1. A hollow golf club head having a sole portion and a crown portion, wherein a ratio of an average thickness of said sole portion to that of said crown portion is 1:0.3 to 0.8, said crown portion includes a crown thin-walled region on a face side and a crown thick-walled region on a back side, said sole portion includes a sole thick-walled region on a face side and a sole thin-walled region on a back side, an area of the crown thin-walled region is larger than that of the crown thick-walled region in said crown portion, and an area of the sole thick-walled region is larger than that of the sole thin-walled region in said sole portion.

2. A hollow golf club head having a sole portion and a crown portion, wherein a ratio of an average thickness of said sole portion to that of said crown portion is 1:0.3 to 0.8, said crown portion includes a crown thin-walled region on a face side and a crown thick-walled region on a back side, said sole portion includes a sole thick-walled region on a face side and a sole thin-walled region on a back side, an area of the crown thin-walled region is larger than that of the crown thick-walled region in said crown portion, an area of the sole thick-walled region is larger than that of the sole thin-walled region in said sole portion, and a head volume is 70 $cm^3$ to 150 $cm^3$ and a loft angle is in a range from 15 to 32 degrees.

3. The golf club head according to claim 1, wherein a ratio of the area of the crown thin-walled region to that of the crown thick-walled region in said crown portion is 1:0.35.

4. The golf club head according to claim 1, wherein a ratio of the area of the sole thick-walled region to that of the sole thin-walled region in said sole portion is 1:0.6.

5. The golf club head according to claim 1, wherein the crown thin-walled region extends from a face side end of the crown portion at least 20 mm toward the back side of the crown portion.

6. The golf club head according to claim 1, wherein the sole thick-walled region extends from a face side end of the sole portion at least 20 mm toward the back side of the sole portion.

7. The golf club head according to claim 1, wherein a thickness of a boundary portion between the crown thin-walled region and the crown thick-walled region is gradually changed.

8. The golf club head according to claim 1, wherein a ratio of a rigidity of said sole portion to that of said crown portion is 1:0.1 to 0.8.

9. The golf club head according to claim 1, wherein the average thickness of said sole portion is in a range of 0.9 mm to 2.0 mm, and the average thickness of said crown portion is in a range of 0.5 mm to 1.2 mm.

10. The golf club head according to claim 1, wherein an average thickness of the crown thin-walled region is in a range of 0.3 mm to 0.7 mm and an average thickness of the crown thick-walled region is in a range of 1.0 to 2.0 mm.

11. The golf club head according to claim 1, wherein an average thickness of the sole thin-walled region is in a range of 0.7 mm to 1.2 mm and an average thickness of the sole thick-walled region is in a range of 1.5 to 3.0 mm.

12. The golf club head according to claim 1, further comprising a side portion, wherein an average thickness of said side portion is in a range of 0.5 mm to 1.2 mm.

13. A hollow golf club head having a sole portion and a crown portion, wherein a ratio of an average thickness of said sole portion to that of said crown portion is 1:0.3 to 0.8, said crown portion includes a crown thin-walled region on a face side and a crown thick-walled region on a back side, said sole portion includes a sole thick-walled region on a face side and a sole thin-walled region on a back side, an area of the crown thin-walled region is larger than that of the crown thick-walled region in said crown portion, an area of the sole thick-walled region is larger than that of the sole thin-walled region in said sole portion, and a head volume is 150 $cm^3$ to 250 $cm^3$ and a loft angle is in a range from 12 to 28 degrees.

* * * * *